US006252706B1

(12) United States Patent
Kaladgew

(10) Patent No.: US 6,252,706 B1
(45) Date of Patent: Jun. 26, 2001

(54) TELESCOPIC SIGHT FOR INDIVIDUAL WEAPON WITH AUTOMATIC AIMING AND ADJUSTMENT

(75) Inventor: André Kaladgew, 18 rue Eichenberger-92800, Puteaux (FR)

(73) Assignees: Gabriel Guary (FR); Andre Kaladgew (FR)

( * ) Notice: Subject to any disclaimer, the term of this patent is extended or adjusted under 35 U.S.C. 154(b) by 0 days.

(21) Appl. No.: 09/380,957

(22) PCT Filed: Mar. 11, 1998

(86) PCT No.: PCT/FR98/00495

§ 371 Date: Nov. 18, 1999

§ 102(e) Date: Nov. 18, 1999

(87) PCT Pub. No.: WO98/40688

PCT Pub. Date: Sep. 17, 1998

(30) Foreign Application Priority Data

Mar. 12, 1997 (FR) ..... 97/02937

(51) Int. Cl.[7] ..... G02B 23/00

(52) U.S. Cl. ..... 359/399; 359/429; 33/247; 42/101

(58) Field of Search ..... 359/399, 400, 359/429; 42/100, 101; 33/245, 246, 247, 248

(56) References Cited

U.S. PATENT DOCUMENTS

| | | | | |
|---|---|---|---|---|
| 3,340,614 | * | 9/1967 | Leatherwood | 33/246 |
| 4,114,302 | * | 9/1978 | Litman | 42/101 |
| 4,317,304 | * | 3/1982 | Bass | 42/101 |
| 4,397,107 | * | 8/1983 | Holden | 42/101 |
| 4,531,052 | * | 7/1985 | Moore | 235/404 |
| 4,777,352 | * | 10/1988 | Moore | 235/404 |
| 5,026,158 | * | 6/1991 | Golubic | 356/252 |
| 5,375,072 | * | 12/1994 | Cohen | 364/561 |
| 5,740,037 | * | 4/1998 | McCann et al. | 364/400 |

FOREIGN PATENT DOCUMENTS

| | | | |
|---|---|---|---|
| 2907373 | * | 8/1980 | (DE) . |
| 3325755 | * | 1/1985 | (DE) . |
| 4218118 | * | 12/1993 | (DE) . |
| 2344807 | * | 10/1977 | (FR) . |
| 2474679 | * | 7/1981 | (FR) . |

* cited by examiner

*Primary Examiner*—Cassandra Spyrou
*Assistant Examiner*—Mark A. Robinson
(74) *Attorney, Agent, or Firm*—Piper Marbury Rudnick & Wolfe

(57) ABSTRACT

The invention concerns a telescopic rifle sight for individual weapon equipped with at least one step micro-motor designed to vary the angle of the sight relative to the axis of the weapon and the initial axis of aim, thereby adequately varying the whole sight assembly and thus varying the original position of the sight reticle from the original point of aim to the required point of aim.

6 Claims, 3 Drawing Sheets

TELESCOPIC SIGHT FOR INDIVIDUAL WEAPON WITH AUTOMATIC AIMING AND ADJUSTMENT

FIELD OF INVENTION

The present invention relates to a telescope sight for an individual weapon enabling very high-precision firing for hunting, target shooting and anti-personnel fire

BACKGROUND OF INVENTION

Modern shooting techniques enable elite marksmen equipped with modern 12.7 m/m calibre weapons, for example, to shoot from very long distances.

Conventional sights have become limited for this type of shooting because at distances of from 1,000 to 1,500 meters, the evaluation error of the distance and interpretation of the drop of the bullet causes aiming errors. It has become indispensable to use an electronic and computer-assisted system.

For several years, sights have been available which use the displacement of lines forming the sight reticle or the displacement of pixels forming the reticle on a colour or black and white liquid crystal screen (LCD).

However, the fact of displacing the point of aim relative to the central axis of sight of the rifle sight causes aiming errors due to distortion of the view through the sight since, outside the central zone of the lens, the rest of the lens is subjected to vignetting, namely blurring and visual distortion. In the optical field, this phenomenon is known to increase the greater the distance between marksman and target.

Furthermore, any marksman using a rifle with a sight is aware that the fact of moving his eye relative to the central axis of sight of the rifle sight will cause a black halo to appear, blocking the line of vision. This is all the more visible, the smaller the diameter of the individual lenses forming the objective.

For a target such as a tank or light vehicle, this does not have a decisive effect since, because of the large size of the target, an error of 20 or 30 centimeters on impact will not prevent the target from being hit, but when it comes to anti-personnel fire, hunting or target shooting, it is vital, because of the small size of the target, to have a perfect, non-distorted view, i.e. irrespective of the distance of the target and the correction applied to the aim, the line of sight must be centred relative to the axis of the rifle sight, if errors due to vignetting of the lens are to be avoided.

SUMMARY OF THE INVENTION

The objective of the invention is to remedy the disadvantages outlined above and to do so by simple, effective and inexpensive means.

To this end, the invention proposes a telescope rifle sight for an individual weapon, essentially characterised in that it is fitted with at least one step micro-motor designed to vary the angle of the sight relative to the axis of the weapon and the initial point of aim, thereby adequately varying the whole sight assembly and thus varying the original position of the sight reticle from the original point of aim to the required point of aim.

Accordingly, it is not the lines forming the sight reticle which move but the sight assembly, relative to its original axis, in a given manner, assisted by one or two step micro-motors so as to bring the point of aim of the reticle to the required aiming mark depending on the distance and the drop of the bullet at this distance. The marksman will barely notice the displacement of the sight, having a perfect view of the target. He will therefore keep the reticle constantly sighted on the target. Furthermore, a marksman who is used to conventional rifle sights will not be disoriented by the position of the reticle.

The telescope rifle sight proposed by the present invention may optionally also incorporate one or more of the following features:

- a laser beam rangefinder which transmits the distance marksman/target to a computer which holds in memory the drop of the bullet at this distance;
- a first step micro-motor is positioned so as to allow the sight to be pivoted about a horizontal axis in order to correct the aim up or down relative to the point zero, depending on the distance and the drop of the bullet;
- a second step micro-motor is positioned so as to allow the sight to be pivoted about a vertical axis in order to correct the aim in terms of bearing to the right and left relative to the point zero depending on the direction of the wind and/or the displacement of the target;
- the sight incorporates batteries which may or may not be rechargeable and solar cells designed to recharge them; and
- the sight incorporates a zoom camera, a LCD screen which can be pivoted about its attachment, the screen displaying the sight reticle and various pieces of information about firing, a computer, an invisible laser beam rangefinder, a visible laser beam pointer, an audio-video recording system, an audio-video transmitter-receiver, solar cells, power batteries which may or may not be electrically rechargeable, three external sockets, a frame enabling all the components of the sight to be mounted, the unit as a whole being attached to the weapon, and a protective cap for the unit.

BRIEF DESCRIPTION OF THE DRAWINGS

Two examples of embodiments proposed by the invention will now be described with reference to the appended drawings, of which.

DESCRIPTION OF PREFERRED EMBODIMENTS

Figure 1:
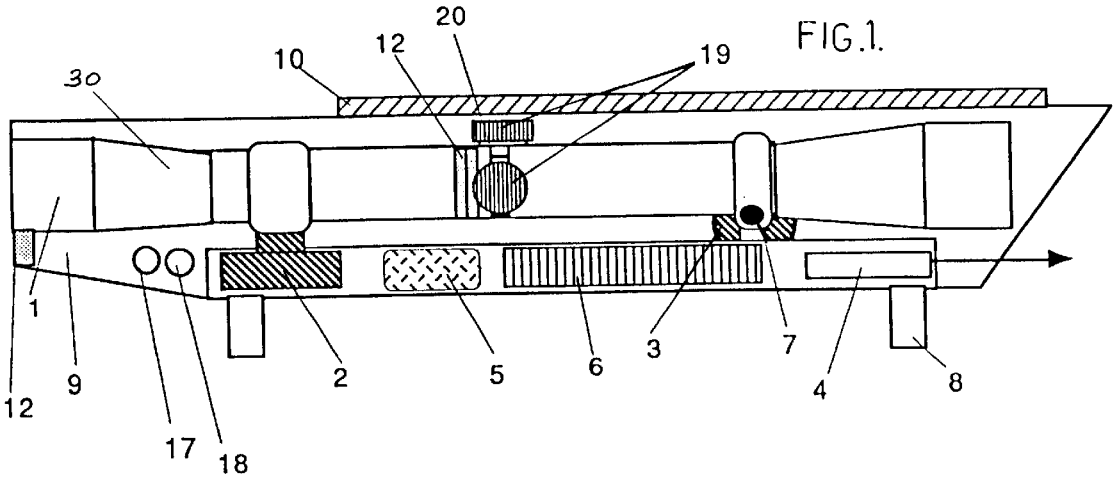
FIG. 1 is a view in longitudinal cross-section of a first embodiment of the telescope sight proposed by the invention.
Figure 6:
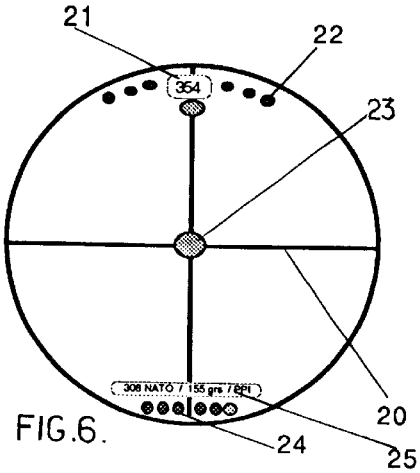
Figure 7:
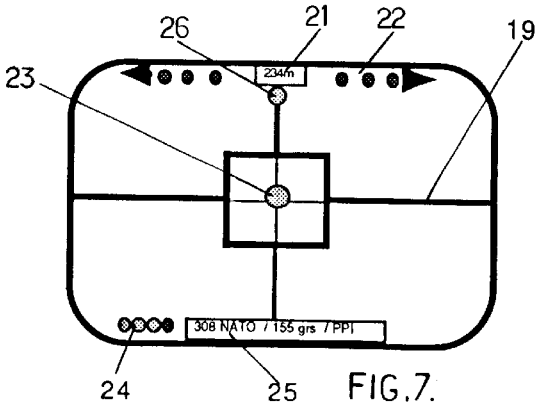
Figure 9:
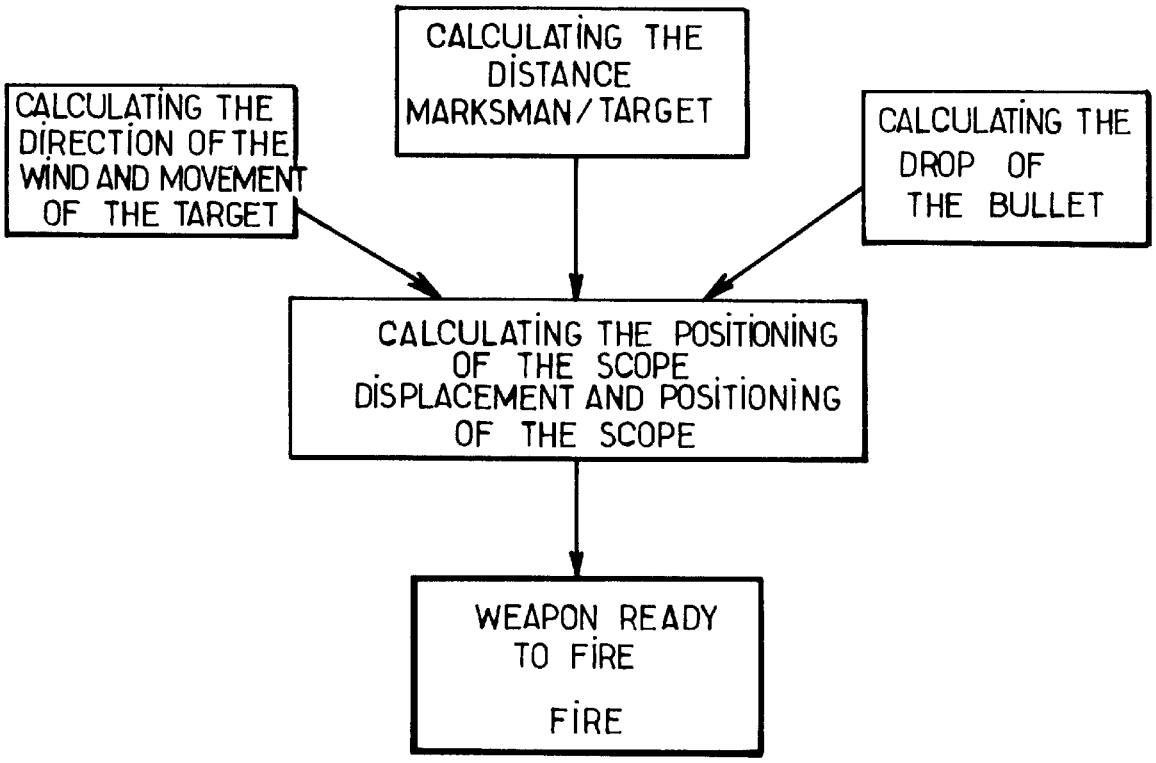

In a first embodiment illustrated in FIG. 1, the telescope sight 1 has a body 30 mounted on a support frame 8 and arranged in a protective cap 9, for example. The body 30 is mounted so that it can be pivoted about a horizontal pin 7, which is in turn joined to the frame 8. Fixed in this body in a manner known per se are optical means such as a lens and an eyepiece. The sight also has, mounted on the body 30, an initial reticle fitted with its adjusting knobs 19, a LCD screen 12 the purpose of which is to display information to the marksman (distance marksman/target, ammunition engaged, the power level of the batteries, a computer signal illustrated in FIGS. 6 and 7) and which is positioned in the vicinity of the reticle or eyepiece. An invisible laser beam rangefinder 4 and a computer 6, power batteries 5 which may or may not be rechargeable, and solar cells 10 are mounted on the support frame 8.

Two step micro-motors 2 and 3 are inserted between the support frame 8 and the body 30 so as to be able to adjust the position of the sight unit relative to said frame 8.

Figure 8:
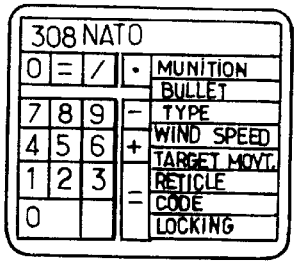

Two external sockets are also provided on the cap: one socket 17 is provided as a means of positioning, at the choice of the marksman, three flexible contactors: a contactor to reset the computer to zero, a contactor to activate the system and a contactor for selecting the ammunition (standard, armour-piercing, explosive, incendiary, etc.) which may be automatic or manually controlled; a second socket 18 is provided as a means of connecting the sight to a programming unit (FIG. 8) so as to record the settings which the computer will need (type of ammunition, bullet, weight, drop of the bullet, menu for the reticle model, etc.).

"Step" motors are used by preference due to their positioning accuracy and ability to hold position as compared with other types of micro-motors, although these could be used without departing from the sight of the invention.

Figure 2:
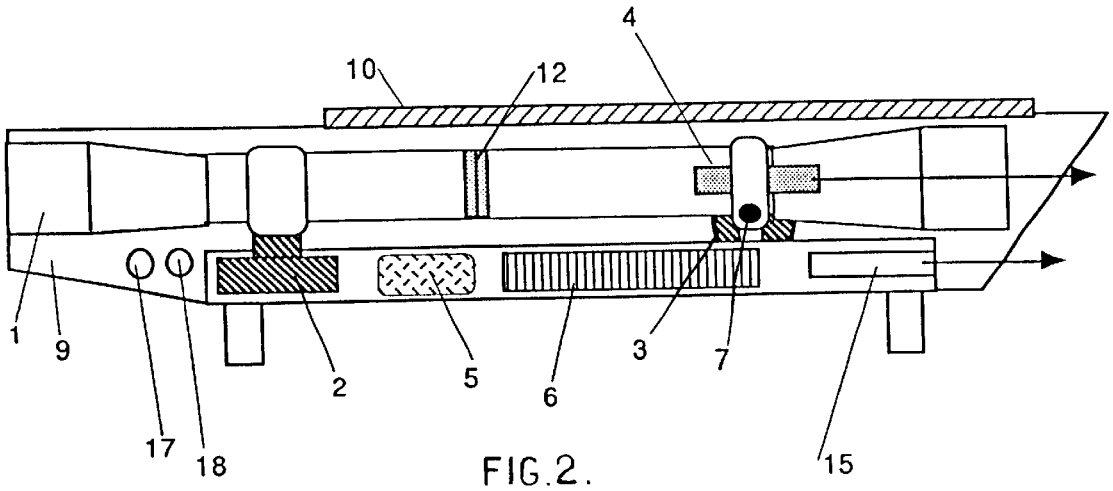
FIG. 2 is a view in longitudinal cross-section of another embodiment of the sight illustrated in FIG. 1.

A variant of the first embodiment is illustrated in FIG. 2 and differs from this embodiment only insofar as some of the component elements are different. An visible laser beam pointer 15 is mounted on the support frame 8 whilst the invisible laser beam rangefinder 4 is disposed directly on the cap of the sight. Furthermore, the sight reticle is no longer connected to adjusting knobs.

Figure 3:
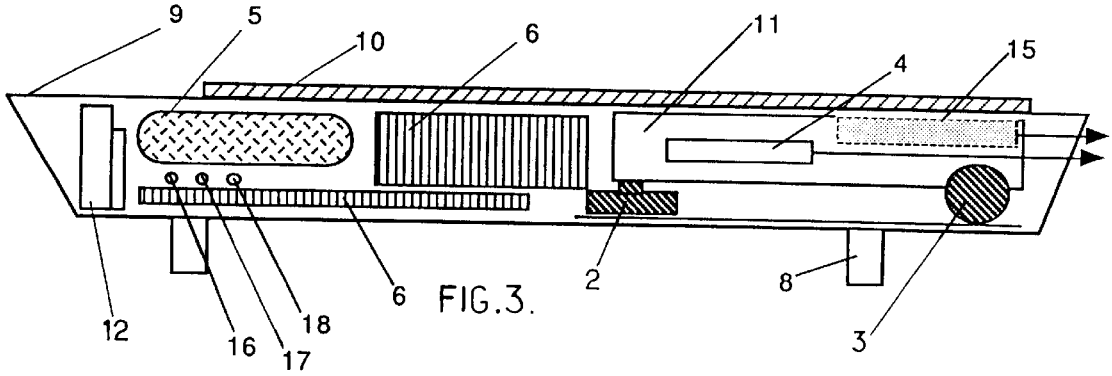
FIG. 3 is a view in longitudinal cross-section of a second embodiment of a telescope rifle sight as proposed by the invention.
Figure 5:
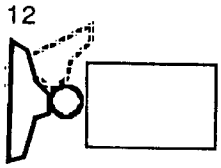
FIGS. 5 to 9 are schematic illustrations of accessories mounted on the sight and their operating mode.

In a second embodiment, the telescope sight illustrated in FIG. 3 is also placed in a protective cap 9 and consists of a LCD screen 12 which can be oriented about its fixing (FIG. 5) for the purpose of viewing the target and displaying the sight reticle along with the information needed for firing purposes (FIGS. 6 and 7), a video camera 11 equipped with a motorised zoom, an invisible laser beam rangefinder 4, a visible laser beam pointer 15, a computer 6, a programming unit (FIG. 8), a sensor for detecting ammunition by bar coding, colorimetric or magnetic means, power batteries which may or may not be electrically rechargeable 5, solar cells 10, one or two step micro-motors 2 and 3 and a support 8 with two bases enabling the sight to be connected to the weapon. The computer memory stores different types of reticles which the marksman may select for display depending on his preference or the shooting conditions.

The unit comprising the camera, zoom, laser pointer and laser rangefinder is a single-block unit and is fixed onto a mobile plate which is held by the step motor 2 on one end so as to raise or lower the unit in elevation about a horizontal axis and may be held at the other end by the other step motor 3 so as to provide orientation bearing to the right or left about a vertical axis.

An external socket 16 is provided for connecting another video screen which can be attached to the helmet of a soldier, for example, enabling him to see, take aim and fire without shouldering the weapon. If keeping hidden, at the corner of a street for example, this screen makes it possible to cover a zone, possibly take aim and fire, without being exposed to the enemy, leaving only the weapon exposed.

Another socket 17 is provided so that the marksman can position, as he desires, three flexible contacts for resetting to zero and activating the sight and selecting the ammunition (standard, armour-piercing, explosive, incendiary, etc.).

A third socket 18 is provided, linking the sight to a programming unit (FIG. 8) in order to record the settings which the marksman will need (type of ammunition, bullet, weight, drop of the ammunition, etc.). The laser pointer is in turn designed to have a deterrent effect when used by riot control forces, for example.

A system of solar cells 10, the purpose of which is to power the batteries at any time but simultaneously to recharge them, is integrated in the unit.

Figure 4:
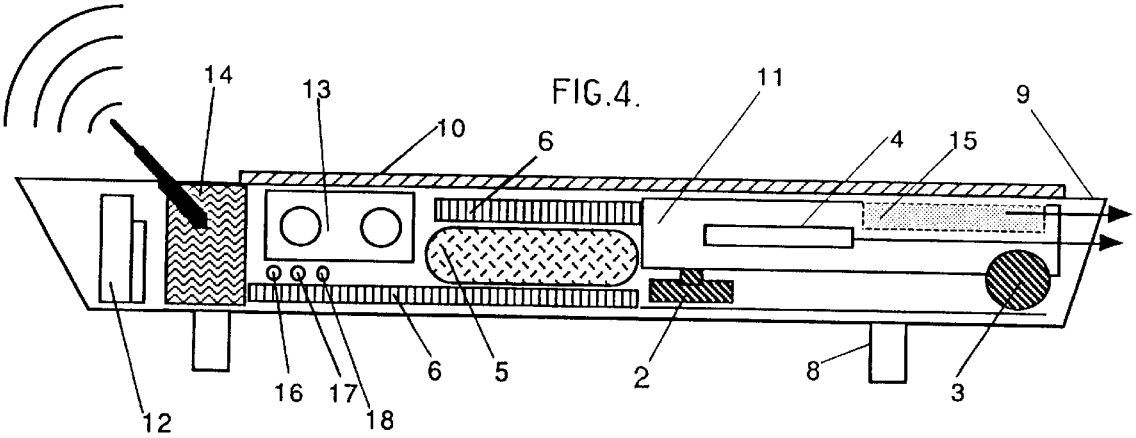
FIG. 4 is a view in longitudinal cross-section of a different embodiment of the telescope sight illustrated in FIG. 3.

A variant of the second embodiment is illustrated in FIG. 4 and differs from this embodiment in that it also has a video cassette recorder 13 and a micro-audio-video transmitter-receiver 14.

The video recording system 13 is provided so as to be able to direct the action, for example during training or during active service.

The audio-video transmitter-receiver 14 is provided so that a command post, for example, will be able to follow ongoing engagements or also to send information to the screen addressed to the soldier.

In the case of both embodiments (and their variants) of sights described above, the common principle is that of displacement assisted by step micro-motors of all or a part of the sight instead of moving lines forming the reticle, as happens with other systems.

In the first embodiment, the marksman aims at his target through the telescope sight 1 in the conventional manner by operating the start button, the marksman activates the laser rangefinder 4 which calculates the distance marksman/target and transmits the information to the computer. Storing the drop of the bullet at this distance in its memory, said computer 6 therefore determines the new position of the sight reticle as a function of the distance and the drop of the bullet and the sight unit 1 is therefore displaced by means of the step micro-motor 2 so as to bring the sight reticle to the requisite point of aim so that the bullet will reach the target at the given point. The micro-motor 3 enables the orientation of the sight to be adjusted depending on the wind and/or the direction in which the target is moving.

The device proposed by the invention therefore allows the angle of the sight unit to be varied relative to the axis of the weapon and the initial axis of aim in terms of elevation and/or bearing.

Since the displacement of the sight is barely perceptible and the reticle always centred in the sight, the marksman is therefore not hampered, does not lose the target from sight and can therefore shoot to hit the target successfully.

The operating principle of the second embodiment is identical to that of the first telescope sight of the first embodiment, except that the camera-zoom unit and the laser rangefinder are displaced by the step micro-motors 2 and 3 following the same principle as above. The marksman does not have the impression that the sight is moving at all.

As a result of the principle of the video screen which can be observed from any angle of view, the marksman no longer needs to align his sight with the axis of the sight as is the case with a conventional sight and can aim regardless of his position relative to the screen.

For example, a soldier equipped with a device of this type can position the weapon from a street corner in the direction of a sector to be controlled whilst himself remaining protected behind the wall forming the comer of the street.

What is claimed is:

1. Telescopic sight for an individual weapon, comprising at least one step micro-motor designed to vary the angle of the sight relative to the axis of the weapon and an initial axis of aim and a laser beam rangefinder which determines the distance between a marksman and a target and transmits the distance to a computer having stored in memory a drop of a bullet at this distance, said computer controlling said at least one step micro-motor based upon the determined distance and the drop of the bullet at this distance, thereby adequately varying the whole sight assembly and thus varying the original position of the sight reticle from the original point of aim to a required point of aim.

2. Telescopic sight according to claim 1, wherein a first step micro-motor is positioned so as to enable the sight to be pivoted about a horizontal axis in order to correct the aim up or down relative to a point zero, depending on the distance and the drop of the bullet.

3. Telescopic sight according to claim 1, wherein a second step micro-motor is positioned so as to enable the sight to be pivoted about a vertical axis in order to correct the aim in terms of bearing to the right or left relative to a point zero depending on the direction of the wind and/or the displacement of the target.

4. Telescopic sight according to claim 1, wherein it has batteries, whereby the batteries may or may not be rechargeable.

5. Telescopic sight according to claim 4, wherein the batteries are rechargeable, and further including solar cells for the purpose of recharging the batteries.

6. Telescopic sight according to claim 1, wherein the sight has a zoom camera, an LCD screen which can be pivoted about its fixing, a screen on which the sight reticle is displayed along with various items of information relating to firing, a visible laser beam pointer, an audio-video recording system, an audio video transmitter-receiver, solar cells, power batteries, three external sockets, a frame enabling all the sight components to be attached, a fixing for connecting the sight onto the weapon and a protective cap for the sight.

* * * * *